United States Patent [19]

Logsdon

[11] Patent Number: 4,865,072

[45] Date of Patent: Sep. 12, 1989

[54] WASHING MACHINE CONNECTION BOXES

[76] Inventor: Duane Logsdon, 1708 Calavera Dr., Fullerton, Calif. 92631

[21] Appl. No.: 291,067

[22] Filed: Dec. 28, 1988

[51] Int. Cl.[4] ..... F16L 5/00; A47B 67/02

[52] U.S. Cl. ..... 137/360; 312/229; 312/242

[58] Field of Search ..... 137/360; 312/229, 242

[56] References Cited

U.S. PATENT DOCUMENTS

| | | | |
|---|---|---|---|
| 2,952,271 | 9/1960 | Pick et al. | 137/360 |
| 3,718,154 | 2/1973 | Doumany | 137/360 |
| 3,831,624 | 8/1974 | Doumany | 137/360 |
| 3,834,781 | 9/1974 | Logsdon | 312/229 |
| 4,069,837 | 1/1978 | Jirasek | 137/360 |
| 4,158,471 | 6/1979 | Logsdon | 137/360 |
| 4,564,249 | 1/1986 | Logsdon | 137/360 |
| 4,716,925 | 1/1988 | Pruther | 137/360 |

*Primary Examiner*—A. Michael Chambers

*Attorney, Agent, or Firm*—Price, Gess & Ubell

[57] ABSTRACT

Washing machine connection boxes can be constructed so as to be useful in a variety of "difficult" or "tight" situations by forming the bottoms of such boxes so that a drain pipe and two water supply lines can be installed so as to be connected to said bottom in whatever sequence or series is most advantageous as a result of the way that such a drain pipe and such lines are provided by a plumber adjacent to the box.

5 Claims, 1 Drawing Sheet

WASHING MACHINE CONNECTION BOXES

Background of the Invention

The invention set forth in this specification pertains to new and improved washing machine connection boxes. More specifically it pertains to boxes as indicated which are especially desirable because of their versatility and the fact that they can be easily used, especially when it is difficult or undesirable to use prior related washing machine connection boxes.

So as to avoid any possible misunderstanding, it is considered desirable to define what is meant by the phrase "washing machine connection box" used in this specification. The expression is used herein is intended to designate a rectangular box-like structure which is designed to be installed in or on a wall, which is specially shaped so valves terminating two water lines and a drain pipe may be connected to it and which has an open side so that hoses leading to a washing machine and a drain tube leading from such a machine may be connected to the valves and the drain pipe, respectively. As the plumbing field has developed and as more and more items for use in this field have been manufactured out of plastic, it has been increasingly common to manufacture such boxes out of various relatively inert, supporting polymers or polymer compositions.

Washing machine connection boxes of the latter category are shown in a number of patents such as the U.S. Pat. Nos.: 3,834,781; 4,158,471 and 4,564,249. Other washing machine connection boxes are disclosed in various references of record in connection with these two patents. It is believed that all of the washing machine connection boxes shown in these references are constructed so at to be adapted to be installed in a wall in the space between two adjacent studs and the walls associated with such studs. The actual volume within such a space will vary depending upon the spacing of the studs and the thickness of these studs. Although the distance between studs in a building is usually standard, and although the thickness of studs is usually standardized, frequently such distance is comparatively limited and on fewer occasions the thickness of studs used may be less than normal.

As a result of these factors it is on occasion impossible to use washing machine connection boxes as are now commonly employed because there is inadequate room to install such boxes. Also it is on occasion impossible or impractical to use washing machine connection boxes such as are now commonplace for an entirely different reason. Such reason pertains to the manner in which both hot and cold water pipes or lines and a drain pipe are installed so as to lead to the area where a washing machine connection box is to be installed.

Traditionally such pipes are installed so that they lead upwardly through a floor—such as a concrete slab or a floor built up using joists and flooring in a conventional manner—between where studs are to be installed or are installed on opposite sides of the drain pipe. The latter also will extend upwardly from the floor or floor area in a similar manner. Unfortunately these two pipes and the drain line do always get installed in this manner. On occasion by design or otherwise a plumber will install both supply lines on one side or the other of a drain pipe in the limited area between two studs. Because of the restricted size of such an area it is frequently impossible or substantially impractical to deform the water lines and the drain line so as to make them useful with a conventional box when this occurs.

Brief Summary of the Invention

As a result of these considerations it is considered that there is a need for new and improved washing machine connection boxes. The present invention is intended to supply this need. More specifically, it is intended to supply connection boxes for the purpose described which are as inexpensive to manufacture as prior related boxes, but which are more desirable than such related prior boxes because they can be installed and used in locations where such prior boxes cannot be used or are not particularly adapted to be used.

In accordance with this invention these objectives of the invention are achieved by providing a washing machine connection box having a rectangular shape and including a top, a bottom, sides, a back and an open front, means located on said sides for mounting said box in the space in between wall studs and the the walls carried by said studs and including in said bottom one of a connection means for attaching said bottom to a drain pipe and two separate knockout means which are different from said connection means located on said bottom for attaching said bottom to valves connected to water lines leading from outside of said box towards said bottom in which the improvement comprises: said bottom including three of said connection means, said three of said connection means being located in a row extending between said sides along said bottom, said two separate knockout means being located adjacent to but spaced from said sides, said connection means closest adjacent to said wall being shaped and located so as to fit around said two separate knockout means, said bottom also including a third of said knockout means located midway between said sides.

Brief Description of the Drawing

Because of the nature of this invention it is best more fully explained with reference to the accompanying drawing in which.

Figure 1:
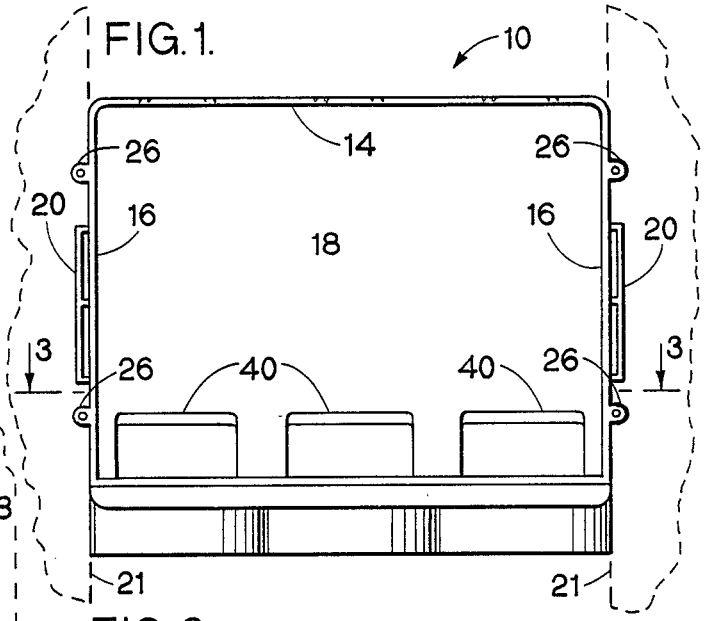
FIG. 1 is a front elevational view of a presently preferred embodiment of a washing machine connection box in accordance with this invention, studs such as this box is adapted to fit between being illustrated in phantom in this view.

The washing machine connection box illustrated in the drawing is constructed so as to utilize the operative, essentially intangible concepts or principles of the invention set forth and defined in the appended claims. Those skilled in the field of the design and construction of new plumbing products will realize that these concepts or principles can be embodied within other somewhat differently appearing and differently constructed connection boxes through the use or exercise of routine engineering skill. For this reason the invention is not to be considered as being limited to the precise structure illustrated and subsequently described.

Detailed Description of the Preferred Embodiment

In the drawing there is shown a washing machine connection box 10 which is preferably formed as a unitary, watertight box out of a known polymer or plastic material such as is used for the construction of closely related washing machine connection boxes. This box 10 is of a generally rectangular shape and includes a bottom 12, a top 14 which is parallel to the bottom 12, sides 16 connecting the top and bottom 12 and 14, and a back 18 connecting the bottom 12, the top 14 and the sides 16. Known bracket means 20 are preferably located on the sides 16 for use in mounting the box 10 on and between conventional studs 21 as shown in phantom in FIG. 1.

Figure 2:
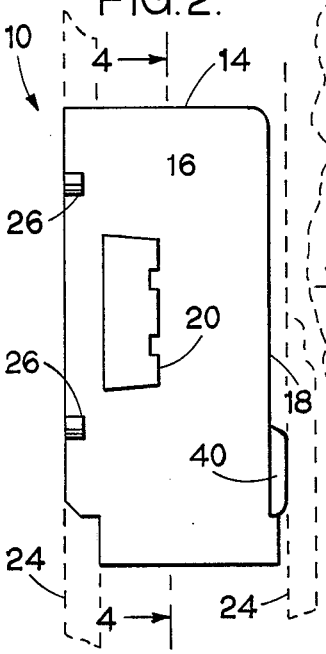
FIG. 2 is a side elevational view of this box, walls such as can be carried by the studs illustrated in FIG. 1 being illustrated in phantom in this view.
Figure 3:
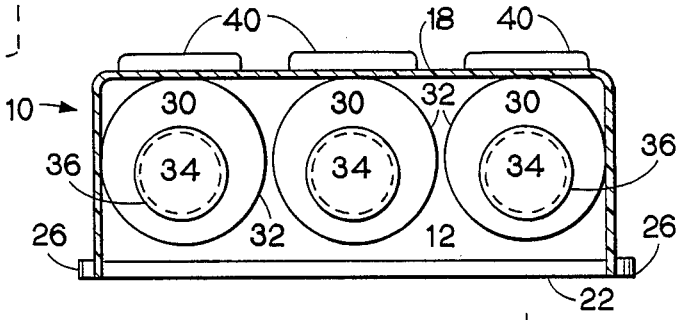
FIG. 3 is a cross-sectional view taken at line 3—3 of FIG. 1.
Figure 5:
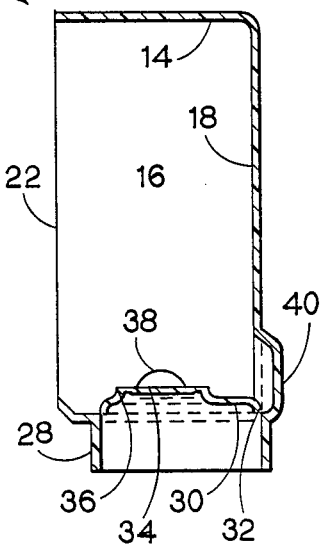
FIG. 5 is a cross-sectional view taken at line 5—5 of FIG. 4.
Figure 4:
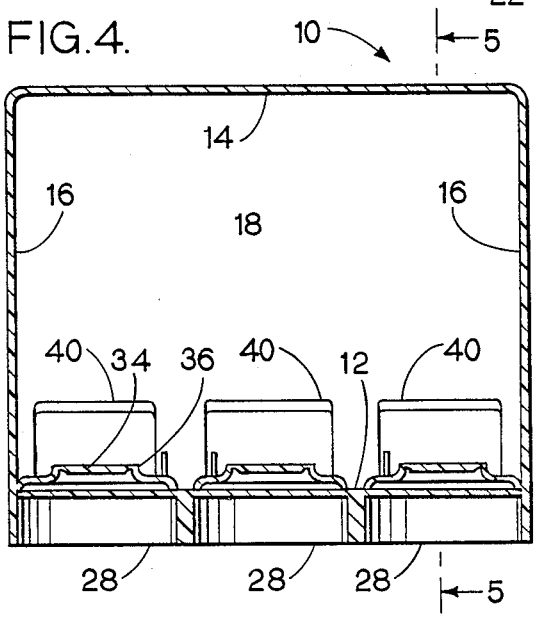
FIG. 4 is a cross-sectional view taken at line 4—4 of FIG. 2.

When the box 10 is so installed an open front 22 extending between the bottom 12, the top 14 and the sides 16 will be exposed generally along one (not separately designated) of two walls 24 carried by these studs 21. These walls 24 are shown in phantom in FIG. 2. If desired a frame (not shown) used for appearance reasons can be attached in a conventional manner to small ears 26 carried by the sides 16. All the construction of the box 10 described in the preceding is conventional.

It is also conventional to construct washing machine boxes so that they include a single cylindrical flange 28 extending from the bottom 12 for use in connecting the box to a drain line (not shown). With the present invention the box 10 includes three of these flanges 20. They are located in the bottom 12 adjacent to but spaced from the sides 16 and midway between the sides 16 so as to be aligned with one another. The bottom 12 includes three aligned knockout plugs 30 separated from the interiors 32 of the flanges 28 by small, easily frangible grooves 32.

With the invention all of the plugs 30 are provided with other, aligned, internal knockout plugs 34 which are segregated from the plugs 30 by means of other grooves 36 corresponding to the grooves 32. If desired, small conventional tabs 38 may be located on the plugs 34 or 30 as illustrated so as to facilitate the removal of these plugs 30 and 34. Which of these plugs 30 and 34 will be removed in a particular installation will depend upon how the supply and drain lines (not shown) are or happen to be installed at such location.

Because of the versatility of the box 10 a plug 30 can be removed to accommodate a drain line (not shown) regardless of where such a drain line is located relative to the water supply lines (not shown) associated with it. Similarly such supply lines (not shown) can be accommodated by knocking out the plugs 34 where they are located regardless of where they are located with respect to a drain line (not shown). This avoids any necessity of squeezing or similarly manipulating pipes so as to be able to connect them to a connection box. Further, because of the nature of the construction employed, the box 10 can be used within a very limited space.

It is important to space the plugs 34 in the plugs 30 so that they are spaced from any adjacent wall sufficiently far as to allow the installation of valves (not shown) in the spaces occupied by these plugs 34. Because of the limited space adjacent to the sides 16 it is preferred to locate the plugs 34 in the plugs 30 in an "eccentric" manner as shown so that they are located as far from the back 18 as reasonably possible so as to facilitate valve installation. Further, in most installations it is relatively acceptable for the back 18 to include small pocket like enlargements 40 adjacent to plugs 34 so as to provide increased room for valve installation.

I claim:

1. A washing machine connection box having a rectangular shape and including a top, a bottom, sides, a back and an open front, means located on said sides for mounting said box in the space in between wall studs and the walls carried by said studs and including in said bottom one of a connection means for attaching said bottom to a drain pipe and two separate knockout means which are different from said connection means located on said bottom for attaching said bottom to valves connected to water lines leading from outside of said box towards said bottom in which the improvement comprises:

said bottom including three of said connection means, said three of said connection means being located in a row extending between said sides along said bottom, said two separate knockout means being located adjacent to but spaced from said sides, said connection means closest adjacent to said wall being shaped and located so as to fit around said two separate knockout means, said bottom also including a third of said knockout means located midway between said sides.

2. A washing machine connection box as defined in claim 1 wherein:

said connection means include cylindrical flanges extending from the bottom of said box beneath said box and knockout plugs located in the bottom of said box within said flanges.

3. A washing machine box as claimed in claim 2 wherein:

said knockout means are other knockout plugs, said knock out plugs being located within said first mentioned knockout plugs.

4. A washing machine box as claimed in claim 3 wherein:

said other knockout plugs are eccentrically located relative to said first mentioned knockout plugs in order to provide room to facilitate the installation of valves in said box.

5. A washing machine box as claimed in claim 5 wherein:

said back wall of said box includes pockets formed therein so as to provide increased room to facilitate the insertion of valves, said pockets being located at least adjacent to some of said other knockout plugs.

* * * * *